US005305539A

United States Patent [19]

Von Kuster

[11] Patent Number: 5,305,539

[45] Date of Patent: Apr. 26, 1994

[54] COLLAPSIBLE FIREARM DEVICE

[76] Inventor: Kent Von Kuster, 2336 Adams Rd., Corbin, Ky. 40701

[21] Appl. No.: 919,024

[22] Filed: Jul. 24, 1992

[51] Int. Cl.[5] ..... F41C 23/04

[52] U.S. Cl. ..... 42/75.01; 42/69.01; 42/72; 42/75.02

[58] Field of Search ..... 42/72, 69.01, 75.01, 42/75.02, 75.04

[56] References Cited

U.S. PATENT DOCUMENTS

| | | | |
|---|---|---|---|
| 666,084 | 1/1901 | Burgess | 42/72 |
| 2,447,091 | 8/1948 | Pope | 42/72 |
| 2,547,180 | 4/1951 | Taylor | 42/72 |
| 3,256,632 | 6/1966 | Beretta | 42/72 |
| 3,619,930 | 11/1971 | Beermann et al. | 42/69.01 |
| 4,383,384 | 5/1983 | Fox | 42/72 |
| 4,625,621 | 12/1986 | Warin | 42/71.01 |
| 4,735,007 | 4/1988 | Gal | 42/72 |

*Primary Examiner*—David H. Brown

[57] ABSTRACT

A firearm configuration composed of a multiplicity of elements which can be assembled into a compact interlocked mutually connected closed configuration for storage, and released and reassembled in an operable configuration to provide a complete operable firearm including a forearm/barrel assembly, upper and lower receiver assemblies, a stock, a bolt assembly, a grip assembly, a magazine assembly, a trigger assembly, and a trigger guard assembly each with special operational and storage features.

15 Claims, 10 Drawing Sheets

COLLAPSIBLE FIREARM DEVICE

BACKGROUND OF INVENTION

The present invention relates to firearms and more particularly relates to self storing firearm devices including several assemblies of individual elements of the firearm where the assemblies can be locked together to provide a storage configuration.

Collapsible folding guns are known in the art as illustrated by U.S. Pat. Nos. 4,625,621 and 1,779,770 which teach arrangements where the elements are not separable but are pivotably connected for assembly and storage.

U.S. Pat. Nos. 4,608,909 and 2,447,091 teach arrangements which provide interchangeable barrels and U.S. Pat. No. 4,383,384 teaches a folding stock for a firearm but these references and similar other references do not teach arrangements to reassemble the elements into a compact stored configuration.

Other references such as U.S. Pat. Nos. 518,950, 3,751,841, 2,958,974, and 2,610,426 teach examples of takedown of disassembly means for firearms but again do not teach arrangements where the elements can be reassembled in another configuration for storage. Again the references do not teach arrangements where the elements are capable of mutual interconnecting to provide a stored firearm.

In general no prior art assembly is known which provides the advantages of devices within the scope of the present invention where the firearm is composed of a number of separable elements some of which can be interconnected to form storage configurations then the storage configurations can be assembled into the storage configuration and the elements disconnected and reassembled to operable configuration. Moreover, while the prior art does provide references which teach devices for allowing ejection of shells from either side of the firearm so the firearm can be used ambidextrously, conversion requires the availability of additional replacement parts. No prior art reference teaches or even suggests the features provided by the present invention for a firearm which allows ambidextrous use.

SUMMARY OF THE INVENTION

The present invention is described hereinafter with reference to locked bolt, gas operated, detachable box magazine, semiautomatic firearms. However, features within the scope of the present invention could be used with other classes of firearms and weapons such as bolt action, pump, or other type firearms as well as crossbows, air guns, and other non firearm type weapons.

Firearms within the scope of the present invention can be configured in collapsed or assembled in operative form. Within the scope of the present invention it has been found that elements of the firearm can be interconnected to form storage sub assemblies and the sub assemblies mutually connected so that a compact integral package can be provided.

In one arrangement within the scope of the present invention a collapsible stock is provided where the butt is formed upon opening of the stock and a collapsing self storing grip is provided.

Additionally, novel barrel attachment means are provided arrangements which feature automatic wear and tolerance compensation. Also provided are gas transfer means which allow for removal of barrel, and single or dual gas cylinders to allow for energy requirements needed to operate gun mechanism for various calibers and cartridges. Arrangements within the scope of the present invention also allow adjustments for shell ejection from either side of the firearm without the need to replace any of the elements of the ejection system.

In addition to the above, other features within the scope of the present invention are novel safety arrangements, novel sighting arrangements, pull adjustment, and other novel features.

Briefly the present invention provides a firearm configuration composed of a multiplicity of elements which can be assembled into a compact interlocked mutually connected closed configuration for storage, and released and reassembled in an operative configuration to provide a complete operative firearm including a forearm/barrel assembly, upper and lower receiver assemblies, a stock, a bolt assembly, a grip assembly, a trigger, and a trigger guard assembly.

Examples and arrangements within the scope of the present invention are illustrated in the accompanying drawings and described hereinafter but will be understood that neither the illustrations nor the descriptions thereof are by way of limitation and that other arrangements also within the scope of the present invention will occur to those skilled in the art upon reading the disclosure set forth hereinafter.

BRIEF DESCRIPTION OF DRAWINGS

The following drawings and descriptions of a preferred embodiment of a gun within the scope of the present invention will show features and advantages of the present invention in which.

All figures hereinafter, with the exceptions of FIGS. 9*b*, 9*c*, and 9*d*, are sectional drawings for the longitudinal central vertical plane as viewed from the right hand side of a preferred embodiment of a collapsible gun in accordance with the present invention, and for greater clarification selected components and shown in wire frame where for ease of referencing from one figure to another the selected combination of cross section and wire frame remain constant for all figures (except as heretofore noted), and ammunition not shown in all depictions.

DETAIL DESCRIPTION OF DRAWINGS

Figure 1:
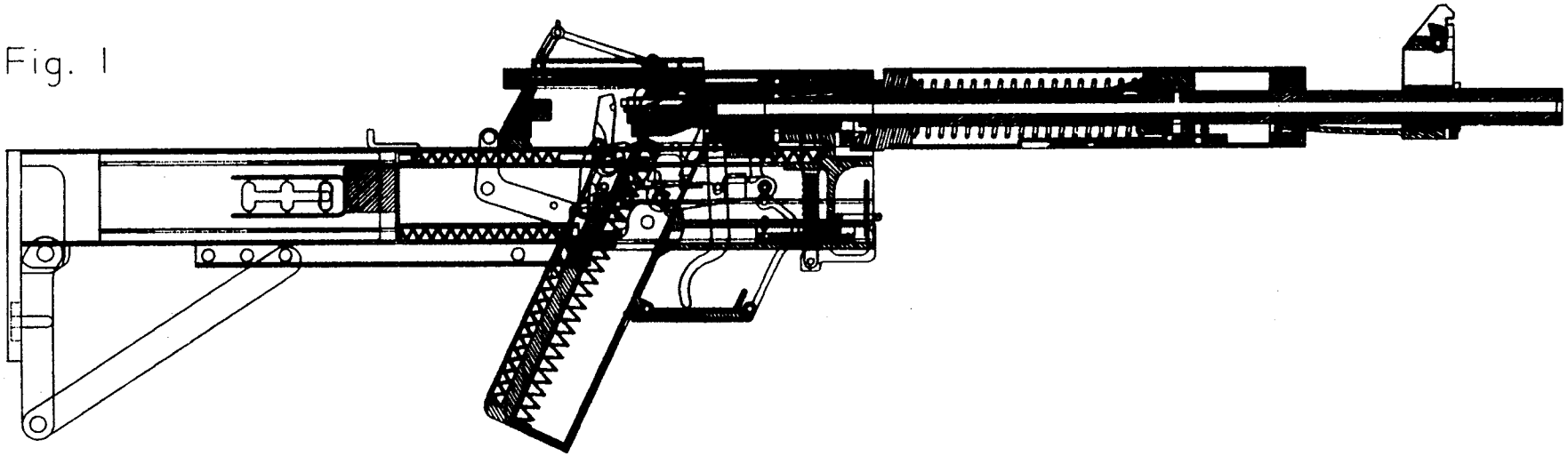
FIG. 1 shows an entire gun in accordance with the present invention assembled in operative configuration generally showing the stock means, grip and trigger guard means, lower receiver assembly, upper receiver and rear sight assemblies, and barrel assembly with front sight assembly.
Figure 2:
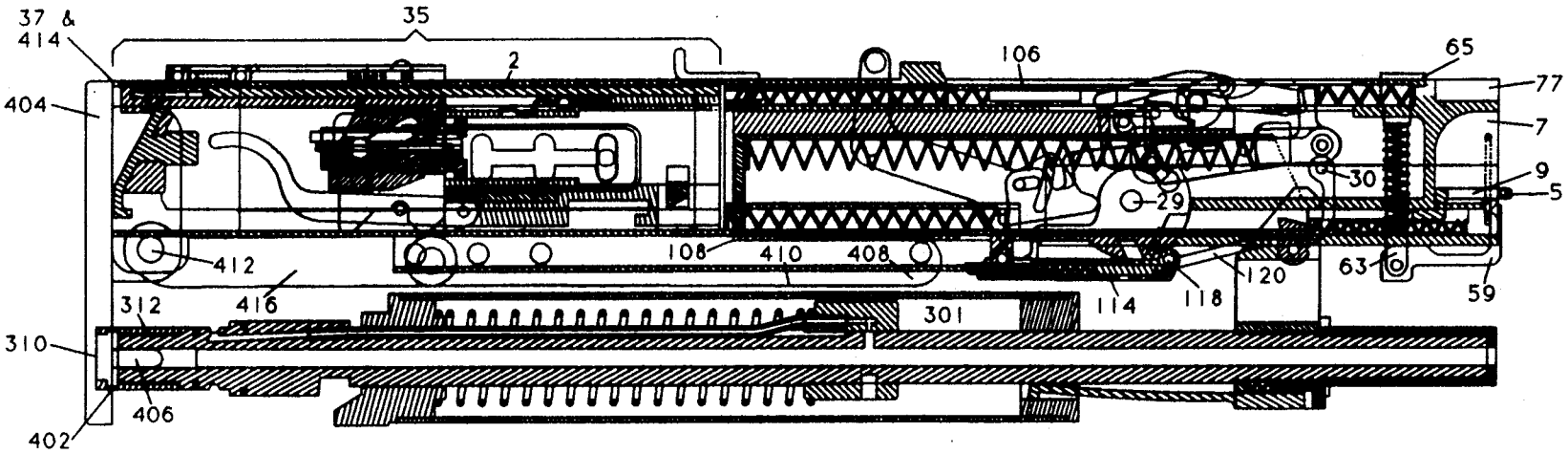
FIG. 2 shows an entire gun in accordance with the present invention assembled in the stored configuration generally showing the relationships of the lower receiver assembly, upper receiver assembly, grip assembly, and barrel assembly.

Referring to the above drawings in greater detail there is shown in FIGS. 1 and 2, in reverse order, a firearm in stored configuration, and a firearm in operable configuration firearm, both within the scope of the present invention. For greater clarification, in FIGS. 4*a*, 4*b*, 5, and 6, respectively, are shown, 1)upper receiver and bolt carrier assemblies, 2)lower receiver, grip, and stock assemblies, and 3)forearm/barrel assembly. These will be referred to hereinafter as Group 1, Group 2, and Group 3 assemblies respectively.

As shown in FIGS. 4*a*, 4*b*, 5, and 6, Group 1 is attached to Group 2 in the operable configuration (see FIG. 1) and is stored within the butt end of the lower receiver in the stored configuration. (see FIG. 2) Group 3 is attached to Group 1 in the operable configuration (see FIG. 1) and is attached to Group 2 in a generally parallel manner in the stored configuration. (see FIG. 2)

Figure 3:
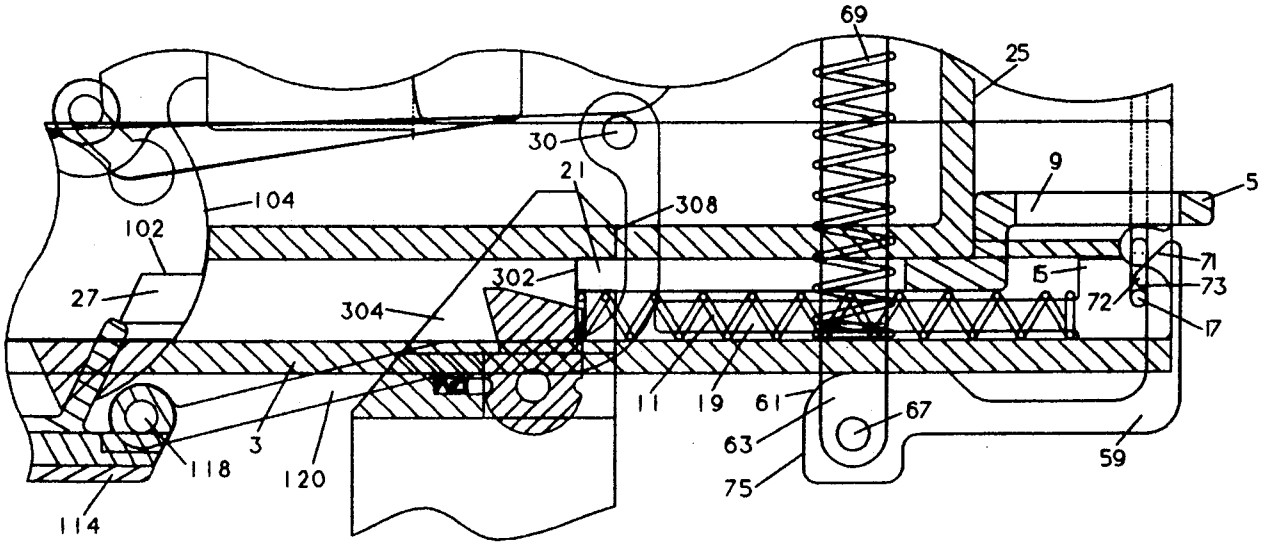
FIG. 3 is an enlarged view of the extreme right central section view as seen in FIG. 2 more specifically showing the relationships of the grip lock and barrel storage lock features as well as the lower section of the receiver lock assembly.

More distinctly for purposes of assembling an operable firearm within the scope of the present invention, as shown by FIGS. 2 and 3, in removing Group 3 from the stored configuration, grip lock 5, is urged in a forward direction against grip lock spring 11 by a finger inserted in finger hole 9 in grip lock 5. Grip lock spring 11 is retained by grip lock spring retainer 15 which is retained in lower receiver 2 by master pin 17. Lateral retention of grip lock spring 11 is accomplished grip lock spring guide 19 which is a rearward extension of grip lock spring retainer 15.

Grip lock 5 is urged forward until barrel assembly locking dogs 21, being central protrusions of grip lock 5, clear storage notches 302 in front sight protection ears 304. The forward end (muzzle end) of Group 3 is then urged downward from lower receiver 2, pivoting Group 3 downward until the front sight protecting ears 304 clear lower receiver 2. Grip lock 5 is then released and Group 3 is urged forward until barrel extension 312 clears forward end of storage safety 406. Group 3 is then temporarily set aside.

Grip lock 5 is then urged forward in a manner similar to that previously said until grip lock dog 27 clears storage notch 102 in grip locking radius 104.

Downward biasing is then applied to grip 101 urging it to pivot around grip pivot pin 29. Grip lock 5 is then released and grip 101 is pivoted downward until grip lock dog 27 engages grip lock notch 31 effectively locking grip 101 in operable configuration. (see FIGS. 1, 5, and 7).

With Group 3 detached from the stored configuration and grip 101 locked in operable configuration we now turn our attention to removing Group 1 from storage in Group 2. (Note: removal of Group 1 from storage in Group 2 can take place before grip 101 is locked in operable configuration. Sequence of these steps in the assembly process are interchangeable.) Gate 404 is rotated anticlockwise around combination pin 412 against combination spring (not shown) until point 414 of gate 404 is lower than storage bay floor 33 of lower receiver 2. This is the open position for gate 404. Rearward biasing is then applied to Group 1, stored within Group 2 urging it to move rearward until Group 1 clears storage bay 35 and gate 404. Gate 404 is released allowing combination spring (not shown) to rotate gate 404 closed.

Figure 11:
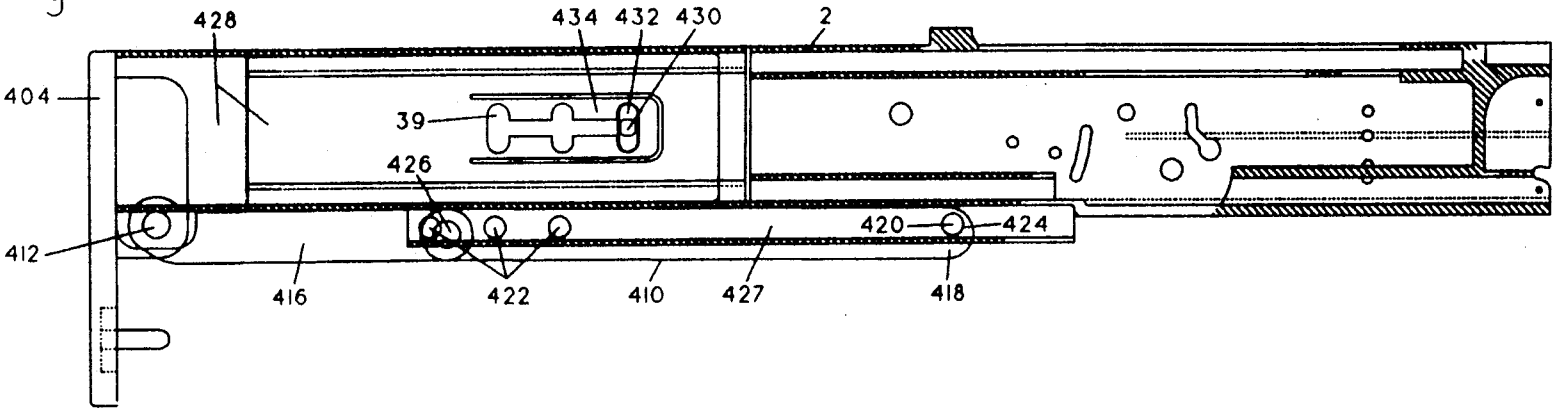
FIG. 11 is a view of the stock assembly in a collapsed configuration.
Figure 12:
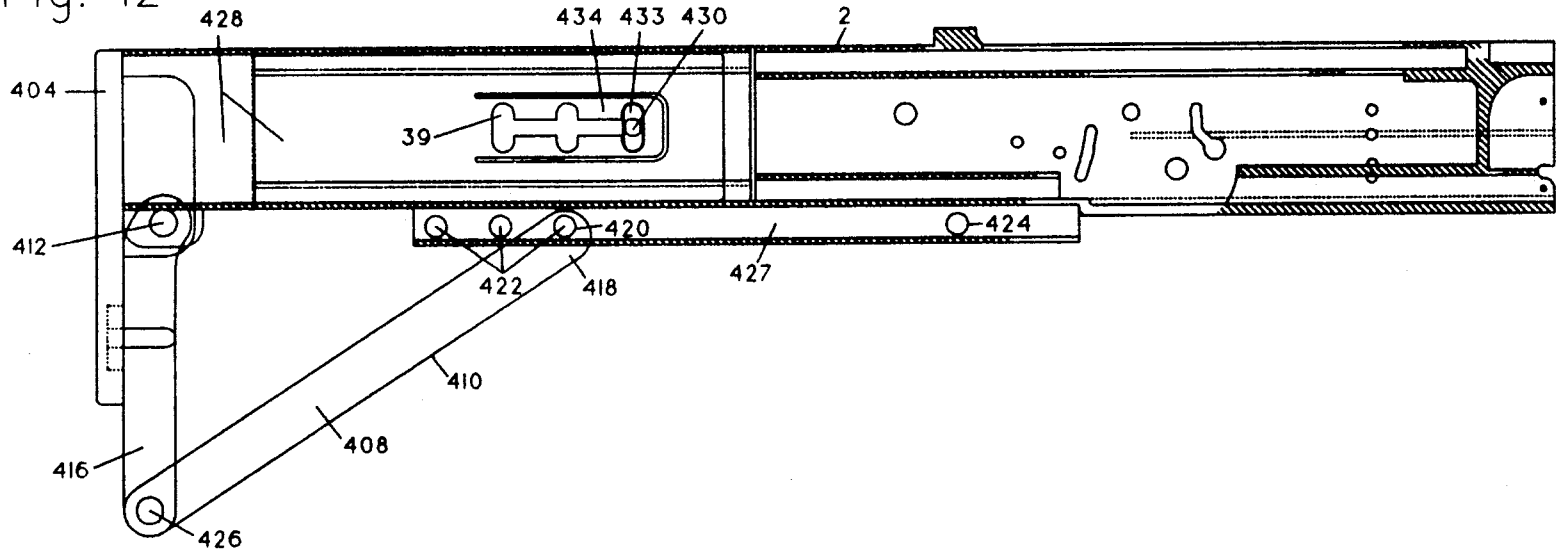
FIG. 12 is a view of the stock assembly in an open and locked configuration.

The butt stock is comprised of several elements. The upper section of the butt of the gun is gate 404. The lower section of the butt of the gun is butt stock rear member 416. The butt of the gun is formed when butt stock rear member 416 is rotated from the stored configuration (see FIG. 11) to the operable configuration (see FIG. 12).

Butt stock forward member 408 is grasped externally near area 418. Both left and right elements of the butt stock forward member 408 are urged inward against outward bias until locking lugs 420 clear storage locking holes 424. When locking lugs 420 inwardly clear storage locking holes 424, butt stock rear member 416, at the urging of combination spring (not shown), rotates clockwise around combination pin 412. Said combination pin 412 is fixed in position relative to lower receiver 2. Said clockwise rotation of butt stock rear member 416 causes butt stock forward member 408 to rotate anticlockwise around butt stock pin 426. Said butt stock pin 426 is of variable location relative to lower receiver 2. As said clockwise and anticlockwise rotations take place locking lugs 420 move rearward in butt stock groove 427 said inward bias is release. Said rearward movement continues until locking lugs 420 align with and lock in forwardmost butt stock locking hole 422 in lower receiver 2. (see FIGS. 5 and 12).

Length of pull is adjustable. If pull needs to be adjusted said pull adjustment is accomplished as follows.

Lower receiver extension 428 is a separable component slideably mated to lower receiver 2. Said lower receiver extension 428 is comprised of three nonseparable elements. The rear element, a separable extension of lower receiver 2, and left and right forward extending arms, slideably attached to the rear section of lower receiver 2.

Said length of pull is adjusted by inwardly biasing pull adjustment locking button 430 against outward bias of pull adjustment lock spring 434 urging said pull adjustment lock button 430 inward until pull adjustment locking lug 432 inwardly clears pull adjustment locking holes 39. Rearward bias is then applied to lower receiver extension 428 urging it rearward until desired pull adjustment hole 39 is aligned with pull adjustment locking lugs 432. Said inward bias being applied to pull adjustment locking button 430 is then released. Pull adjustment locking spring 434 then outwardly urges pull adjustment locking lug 432 into pull adjustment locking hole 39. Butt stock members are then adjusted to match the setting of the pull adjustment such that butt stock rear member 416 is caused to be locked in a position substantially perpendicular to longitudinal axis of lower receiver 2.

Returning to FIGS. 4*a*, 4*b*, and 8. Trigger 203 is placed in the operable configuration by rotating anticlockwise against detent 207 until trigger surface 211 contacts trigger stop surface 213 in recoil block 215. Trigger 203 is now in operative configuration.

Figure 4A:
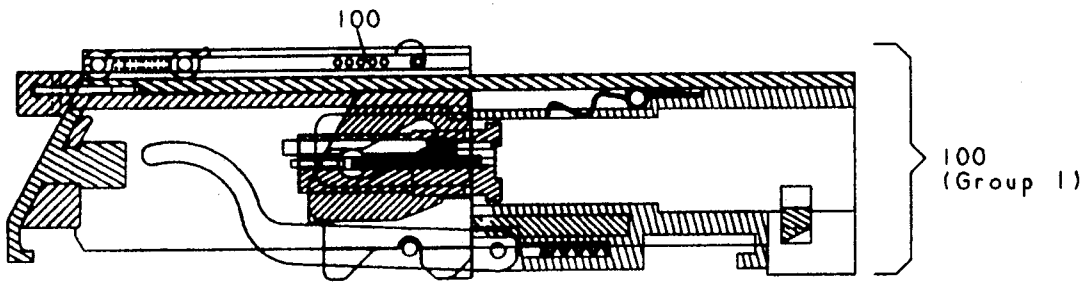
FIGS. 4*a* and 4*b* show the upper receiver assembly and rear sight assembly (Group 1) in the collapsed and open configurations respectively.
Figure 4B:
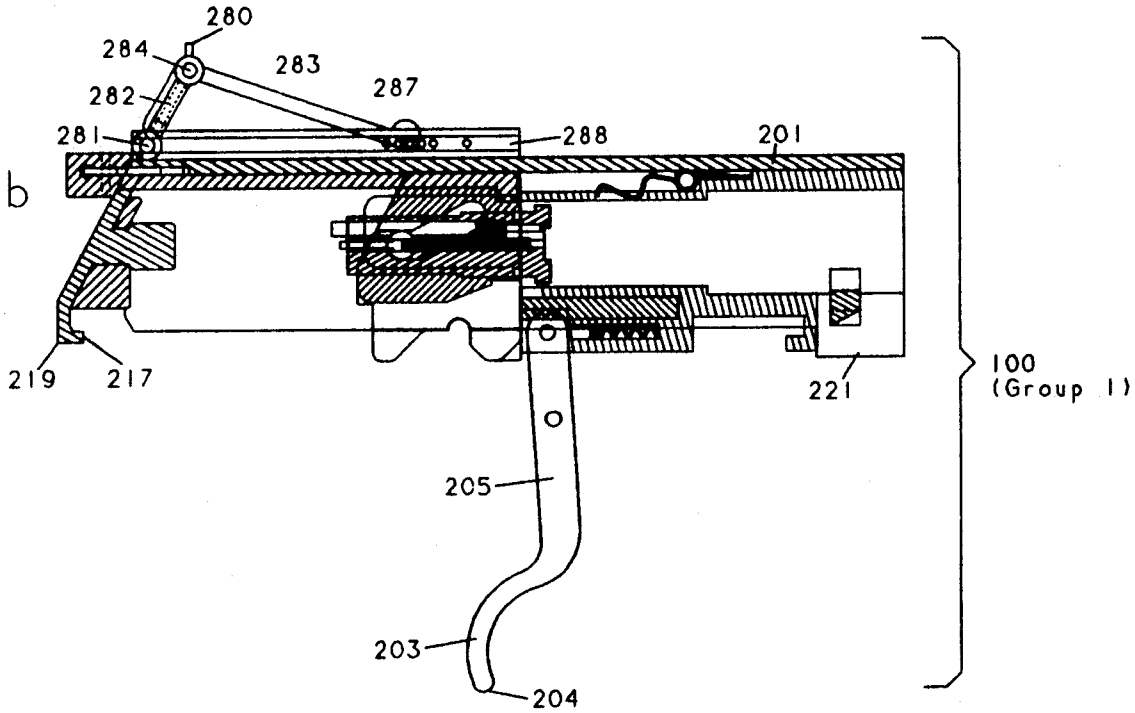
Figure 5:
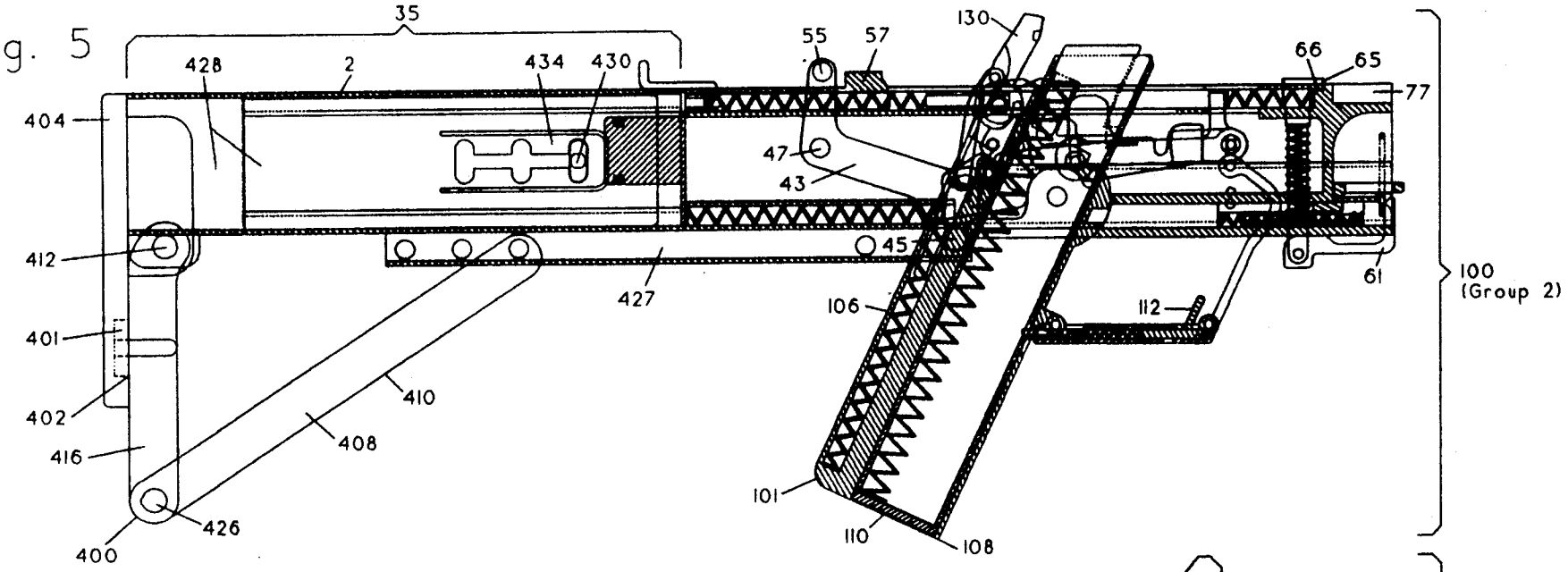
FIG. 5 views the lower receiver, stock and grip/trigger guard assemblies (Group 2) in the open configuration.
Figure 6:
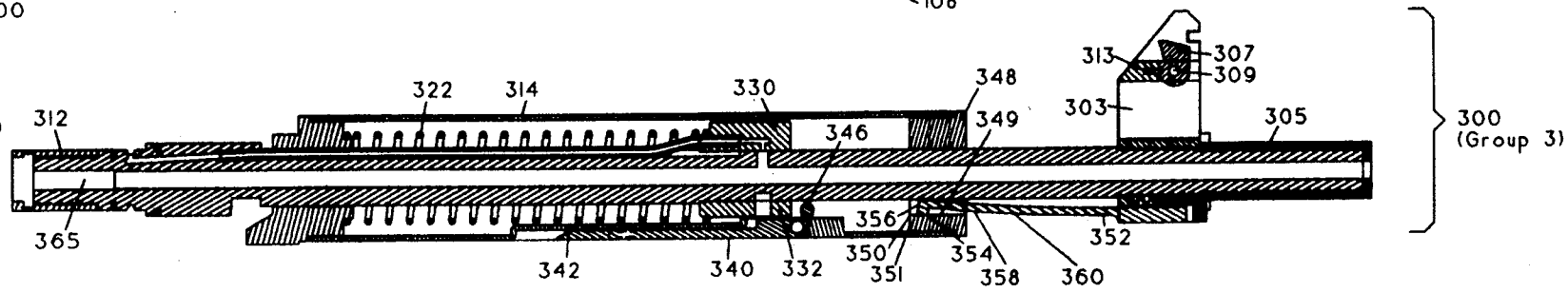
FIG. 6 shows the barrel and front sight assemblies (Group 3)

Group 1, Group 2, and Group 3 are now separate and individually in operable configuration as shown in FIGS. 4*b*, 5, and 6. Next they must be reassembled to form a complete firearm in operable configuration. It will be appreciated that the sequence of assembly may vary from the sequence taught here without affecting the proper operation of the gun.

Referring to FIGS. 4*b*, 5, and 6, hammer 130 is first cocked in a conventional manner.

Safety 43 is engaged by moving safety button 45 (see FIG. 7, and 8) upward causing safety 43 to rotate anticlockwise around safety pivot 47 until point 49 of safety 43 reaches point 51 of safety slot 53. Said anticlockwise rotation also causes assembly safety 55 to move rearward providing clearance for upper receiver assembly tang 217.

Magazine 110 is removed by moving magazine catch 112 forward and removing magazine in a conventional manner.

Receiver lock lever 59 is rotated clockwise substantially 90 degrees. (see FIGS. 3 and 7) A finger (not shown) is inserted through finger hole 9 in grip lock 5 and forward and downward bias is applied to surface 71 of receiver lock lever 59. Said forward and downward bias is increased until tip 72 of receiver lock lever 59 clears master pin 17 allowing receiver lock lever 59 to pivot around receiver lock pin 67. Receiver lock 63 is then urged upward by receiver lock spring 69. As receiver lock cam 61 progressively releases receiver lock 63 to upward movement. Said upward movement of receiver lock 63 continues until receiver lock lever 59 is stopped from clockwise rotation around the horizontal axis of receiver lock pin 67 by surface 75 of receiver lock lever 59. Receiver lock lever 59 is then rotated substantially 180 degrees around the vertical axis of receiver lock 63, causing receiver lock lip 65 to rotate from a forward extending direction to a rearward extending direction.

Group 1 is then grasped from the top and rotated anticlockwise around a floating horizontal axis (not shown) sufficient that tip 204 of trigger 203 and point 219 of assembly tang 217 form a line generally parallel to the upper edge of lower receiver 2. Assembly tang 217 is then aligned with the upper channel (not shown) of lower receiver 2 and inserted between assembly safety 55 and assembly bar 57 of lower receiver 2 and moved forward until assembly tang 217 contacts assembly bar 57. Group 1 is then pivoted clockwise around the contact surfaces of assembly tang 217 and assembly bar 57 causing trigger 203 to move downward. Said pivotal movement continues until lateral alignment lip 221 of upper receiver 201 sockets with lateral alignment socket 77 in lower receiver 2.

Receiver lock lever 59 is then rotated substantially 180 degrees around the vertical axis of receiver lock 63 causing receiver lock lip 65 to rotate from a rearward extending direction to a forward extending direction interleaving with recoil lip 223. (see FIG. 10) Receiver lock lever 59 is then rotated substantially 90 degrees anticlockwise in a horizontal axis around receiver lock pin 67. As said anticlockwise rotation occurs, receiver lock cam 61 causes receiver lock pin 67 to urge receiver lock 63 downward compressing receiver lock spring 69. Said downward movement brings surface 66 of receiver lock lip 65 to bear on surface 224 of recoil lock lip 223. (see FIG. 10) Said camming action continues creating additional downward locking bias until full locked position is reached by receiver locking lever 59. (see FIG. 3).

The remaining major assembly step in making the gun operable in accordance with the present invention is that of coupling Group 3 with Group 1 and 2, Group 1 and 2 already being coupled as previously said. For ease of understanding the following description will consist of two parallel descriptions. The first is a concise prosaic summary. The second is a detailed mechanical description.

Said remaining assembly step is a manually accomplished step which succinctly consists of grasping the forearm assembly around the forearm taking care to keep the front sight housing vertical. The breach end is then inserted into the forward end of the upper receiver assembly until significant resistance is felt. The front sight assembly is then grasped and forcefully moved rearward while bracing the butt of the gun in a convenient manner against body or legs. Rearward force is increased until the barrel lock snaps into place. Firearm is now in operable configuration.

Figure 7:
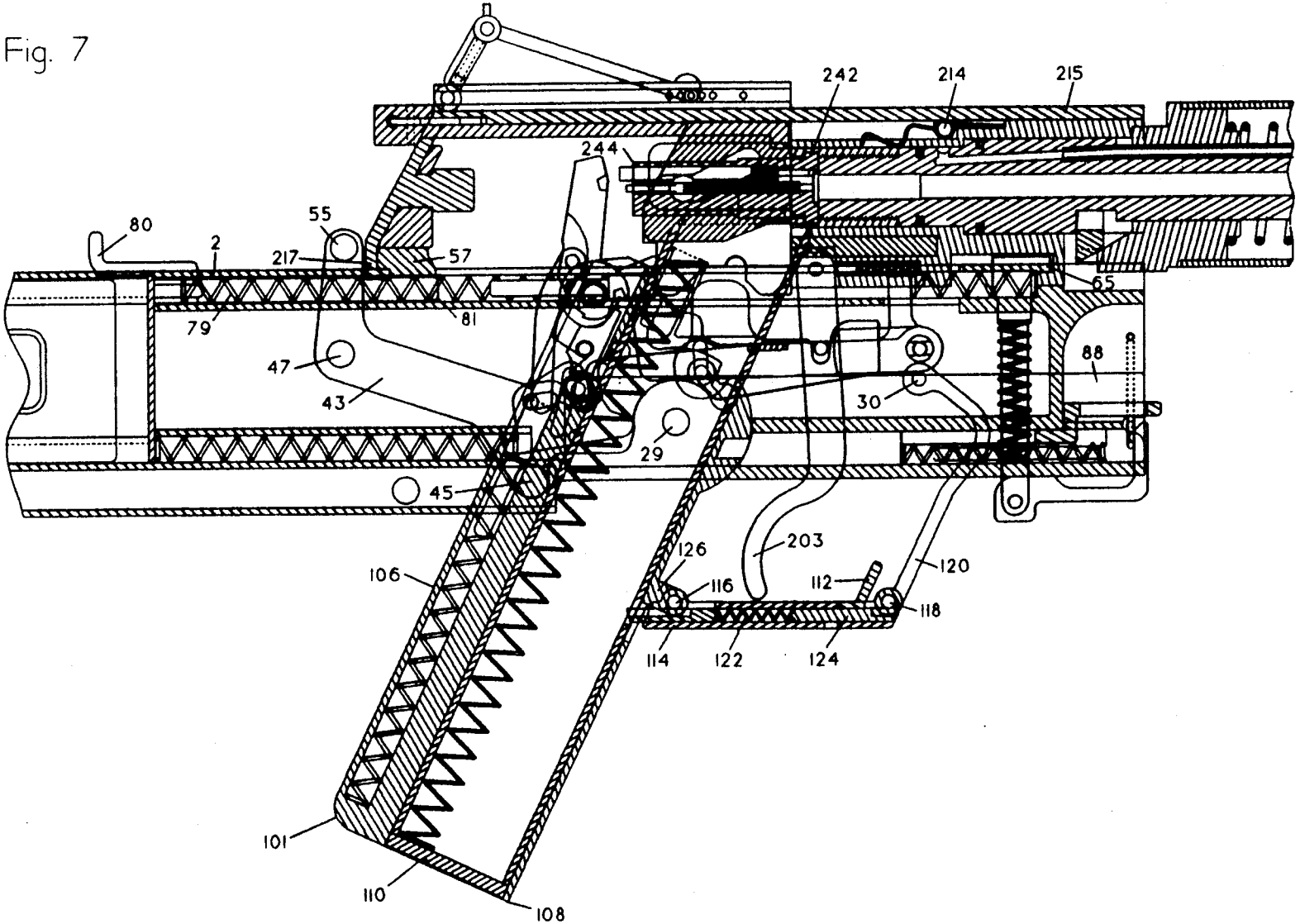
FIG. 7 is a view of the central operating area of a gun in the operative configuration in accordance with the present invention showing more specifically the major interlocking mechanisms and fire control mechanism.
Figure 10:
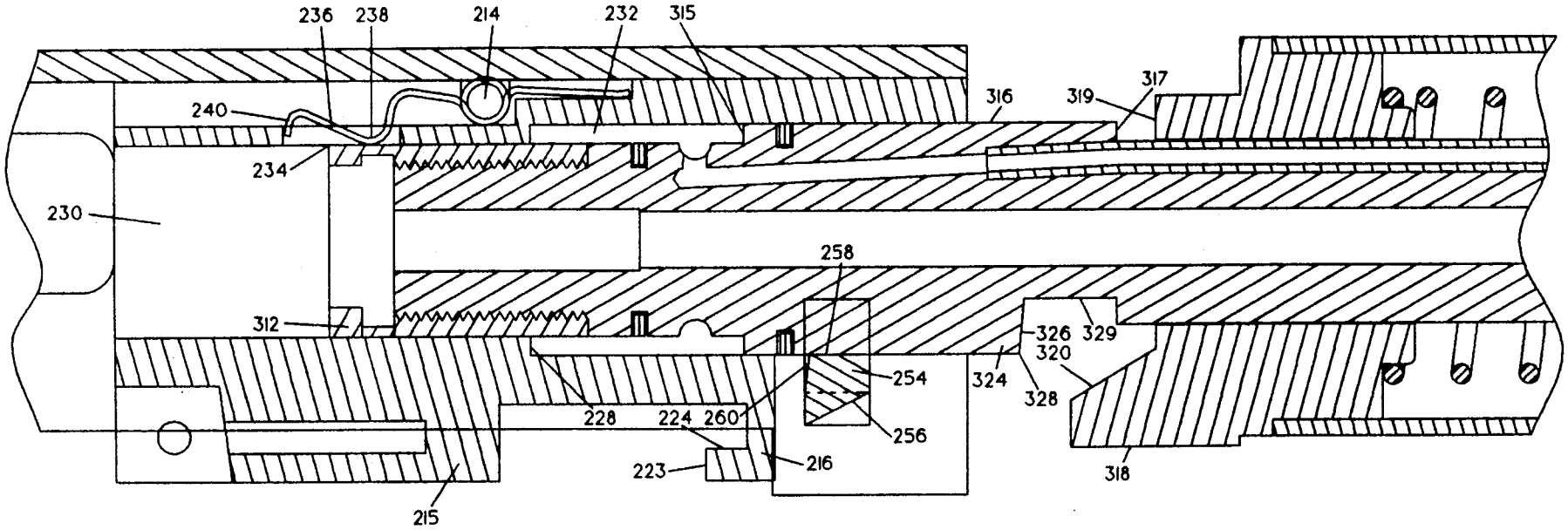
FIG. 10 is a view of the barrel attachment system with the barrel and barrel extension partially socketed.

Mechanical detail of above said description for coupling Group 3 with Group 1 and 2 is as follows. Refer to FIGS. 6, 7, and 10. Grasp Group 3 around forearm 314. Taking care to keep front sight housing 303 vertical move Group 3 rearward inserting barrel extension 312 into forward end of recoil block 215. Barrel extension 312 will loosely socket with recoil block 215 until it reaches stop lip 228. Barrel extension 312 must then be aligned with barrel extension socket 232 of recoil block 215. As said insertion continues rearward point 234 of barrel extension 312 contacts bolt lock 236 at cam surface 238. Further rearward insertion causes point 234 of barrel extension 312 to bear against cam surface 238 camming bolt lock 236 upward. Said upward movement of bolt lock 236 causes bolt lock lip 240 to clear bolt lug 242 (see FIG. 7) releasing bolt 244. Said rearward insertion of Group 3 continues until surface 320 of adjustment wedge 318 contacts surface 256 of barrel locking wedge 254. Said grasp of Group 3 around forearm 314 is then released and Group 3 is then grasped, generally with a split fingered grasp (not shown), with two fingers above front sight retainer 305 and two fingers below front sight retainer 305 and rearwardly biased. Said rearward bias is transferred in successive order through the following components: front sight housing 303, barrel 301, gas block 330, adjustment spring 322, adjustment wedge 318. A portion of said rearward bias is then transferred from adjustment wedge 318 to barrel locking wedge 254 through the contact of surface 320 of adjustment wedge 318 with surface 256 of barrel locking wedge 254. This effectively changes the direction of said portion of said rearward bias substantially 90 degrees resulting in barrel locking wedge 254 having an upward bias. Barrel locking wedge 254, at urging of said upward bias moves upwardly until surface 258 of barrel locking wedge 254 contacts surface 324 of barrel 301. Said upward movement then stops. When said rearward bias being applied to said front sight housing 303 is increased sufficiently to overcome the forward bias of adjustment spring 322 barrel 301 is urged rearward compressing adjustment spring 322. Because of said contact between surface 320 with surface 256 adjustment wedge 318 is held substantially stationary while barrel 301 moves rearward decreasing the distance between point 328 of barrel 301 and point 264 of barrel locking wedge 254. When said point 328 is rearward of said point 264 barrel locking wedge 254, being upwardly biased as previously said, begins to move upward. Said upward movement initiates contact between barrel locking surface 260 of barrel locking wedge 254 and barrel locking surface 326 of barrel 301. A portion of said upward bias of barrel locking wedge 254 is then transferred through the contact of surface 260 with surface 326. This effectively changes the direction of said portion of said upward bias substantially 90 degrees anticlockwise.

The relative distance value of surface 228 to surface 260 as compared to the distance value of surface 315 to surface 326, and the angular relationships of surface 260 and surface 326, are such that when surface 315 of barrel 301 contacts surface 228 of recoil block 215 some distance remains between surface 258 of barrel locking wedge 254 and surface 329 of barrel 301. So long as some of said distance remains between surface 329 and surface 258 barrel 301 will be urged rearward by bias stored in adjustment spring 322 and transferred to barrel 301 in previously said manner. This relationship allows for wear and manufacturing variance in the tolerance relationship of the various component locking surfaces involved in attaching Group 3 to the Group 1 and 2 assembly.

Said grasp of Group 3 around forearm 314 is now released and firearm is in operable configuration.

Ammunition for said firearm is loaded in magazine 110 in a conventional manner and is inserted into firearm in a conventional manner.

Disassembly from operable configuration and reassembly into stored configuration of firearm within the scope of the present invention is accomplished in reverse order and in an applicable parallel reverse manner to that previously said regarding disassembly of firearm from stored configuration and reassembly in operable configuration within the scope of the present invention, except for the following exceptions.

First magazine 110 is removed and gun is cleared of all remaining cartridges.

To remove Group 3 from its locked attachment to Group 1 and 2, anticlockwise bias is applied to disassembly lever 340 near area 342 urging said disassembly lever 340 to rotate about the axis of pin 344. Said anticlockwise rotation causes disassembly lever head 346 to bear against gas block 330 near area 332. As said anticlockwise bias is increased reaction bias transferred through pin 344 urges forearm 314 to move forward moving adjustment wedge 318 forward and out of contact with barrel locking wedge 254. Said anticlockwise bias is continually increased until said forward movement of forearm 314 causes point 350 of forearm bushing 348 to move forward of point 354 of forearm latch 352. Rearward end 356 of forearm latch 352, being downwardly biased, is urged downward until surface 358 of forearm latch 352 contacts surface 349 of forearm bushing 348. Said anticlockwise bias being applied to disassembly lever 340 is then reversed and disassembly lever 340 is returned to the closed position and forearm 314 is held in forward position by contact between surface 351 of forearm bushing 348 and surface 355 of forearm latch 352.

Next downward bias is applied to barrel locking wedge 254 sufficient to urge barrel locking wedge 254 downward until surface 258 of barrel locking wedge 254 has downwardly passed surface 324 of barrel 301. Group 3 is then grasped and urged forward until point 234 of barrel extension 312 passes surface 216 of recoil block 215. Forearm 314 is then released to return rearward by supplying upward bias to forearm latch 352 near area 360 until tip 356 is urged upward sufficient that point 354 of forearm latch 352 clears point 350 of forearm bushing 348. Forearm 314 is then urged rearward by adjustment spring 322 until surface 319 of adjustment wedge 318 contacts surface 317 of barrel 301.

Group 1 is next removed from Group 2 in said reverse order.

Butt stock assembly is then stored in said reverse order.

Grip 101 is then collapsed/stored in said reverse order except for the following exceptions. Magazine 110 is inserted and left in operable configuration. As grip 101 is collapsed hammer 41 will decock automatically.

Group 1 is next stored within Group 2 in said reverse order.

Group 3 is next stored alongside Group 2 in said reverse order.

Gun is now in the stored configuration.

We will now turn our attention to the overall mechanical detail of said firearm within the scope of the present invention.

Figure 13:
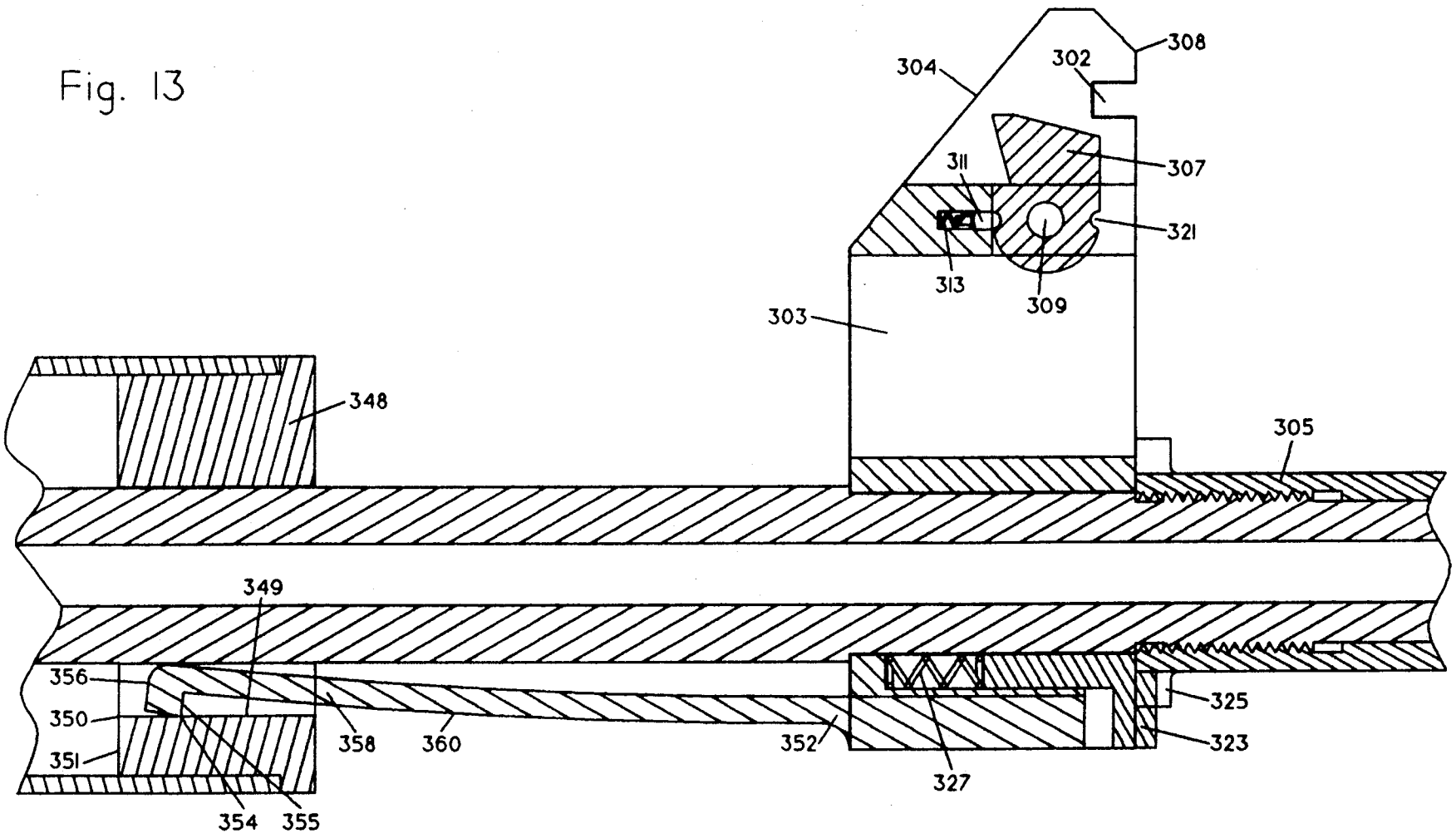
FIG. 13 is an enlarged view of the front sight, front sight housing retainer, and forearm locking assemblies.

Referring to FIG. 13. Front sight housing 303 is retained on barrel 301 by front sight retainer 305. Front sight retainer 305 is radially locked to barrel 301 by front sight retainer lock 323 interlocking in front sight retainer locking notch 325. Said front sight retainer lock 323 is held in said interlocked position by biasing means 327.

Front sight 307 is attached to front sight housing 303 by front sight pin 309. Front sight 307 may be rotated about the lateral axis of front sight pin 309. This allows front sight 307 to be rotated clockwise substantially 180 degrees so that detent stop hole 321 indexes with detent 311. This allows front sight 307 to be removed from the sight picture without removing front sight 307 from the gun. Said rotating procedure is reversed to restore front sight 307 to the sight picture.

In FIG. 4*a* is a view of the rear sight in the collapsed configuration and in FIGS. 4*b* and 7 the rear sight is in the open configuration. Sight blade 280, elevating arm 282, and locking arm 283 are in operative relationship wherein elevating arm 282 is mounted to base means 288 by elevating pivot pin 281 and locking arm 283 is attached to elevating arm 282 by locking pivot pin 284. In operation release tabs 287 are moved inwardly releasing locking studs 285 thereupon locking pivot pin 284 can be either raised or lowered to the desired setting whereupon release tabs 287 are released and locking studs 285 move outwardly into the selected locking holes 286 thereby locking elevating arm 282.

Referring to FIG. 2 it will be appreciated that when gate 404 is in the open configuration Group 1 is inserted into storage bay 35 from left to right for storage within Group 2. It will also be noticed that the top edge of storage bay 35 in lower receiver 2 has no horizontal structural members allowing optical and/or other type sighting devices and/or optional equipment which may be mounted on the top surface of upper receiver 201 to remain mounted when reassembling a firearm within the scope of the present invention to form storage configuration. Also said sighting devices and/or optional equipment can remain mounted to upper receiver 201 during storage.

It will also be appreciated that in storing Group 1 within Group 2 storage plug 34 is socketed in barrel extension socket 230 and barrel socket 232 so that the rear storage seal 32 and forward seal 36 seat in their respective sockets.

Trigger 203 in the operative configuration (see FIG. 7) is surrounded on a plurality of sides by various structural and/or dedicated restricting element/s to protect trigger 203 from nonintentional urging rearward. Said protective device/s are commonly referred to as trigger guard/s and hereinafter will be referred to as trigger guard. Said trigger guard within the scope of the present invention is composed of a plurality of elements, each element of said trigger guard attached to another element of said trigger guard at pivot point. In the preferred configuration of firearm within the scope of the present invention said pivot points are composed of grip pivot pin 29, trigger guard pin 30, magazine release housing rear mount pin 116, and magazine release housing forward pivot pin 118, allowing the elements of the trigger guard to pivot at said pins 29, 30, 116, and 118.

With said preferred configuration of said firearm within the scope of the present invention in the operative configuration, (see FIG. 7) a line drawn connecting adjacent said trigger guard pivot points to form a closed circumference of maximum length forms a four sided polygon. With respect to lower receiver 2 the pivot points of pins 29 and 30 are in a fixed location, while pins 116 and 118 are in a nonfixed location. Said geometric relationships are so arranged that when grip 101 is rotated anticlockwise about pin 29, pins 116 and 118 are urged rearward as grip 101 rotates to the stored configuration and trigger guard elements, magazine catch housing 114 and trigger guard 120, are urged into the stored configuration also. (see FIG. 2).

Magazine catch 112 is slideably locked substantially within magazine catch housing 114 by magazine catch retainer 124. Locking bias is applied by magazine catch spring 122. Magazine catch 112 can be slideably moved forward against rearward bias of magazine catch spring 122 thereby releasing magazine 110.

Figure 8:
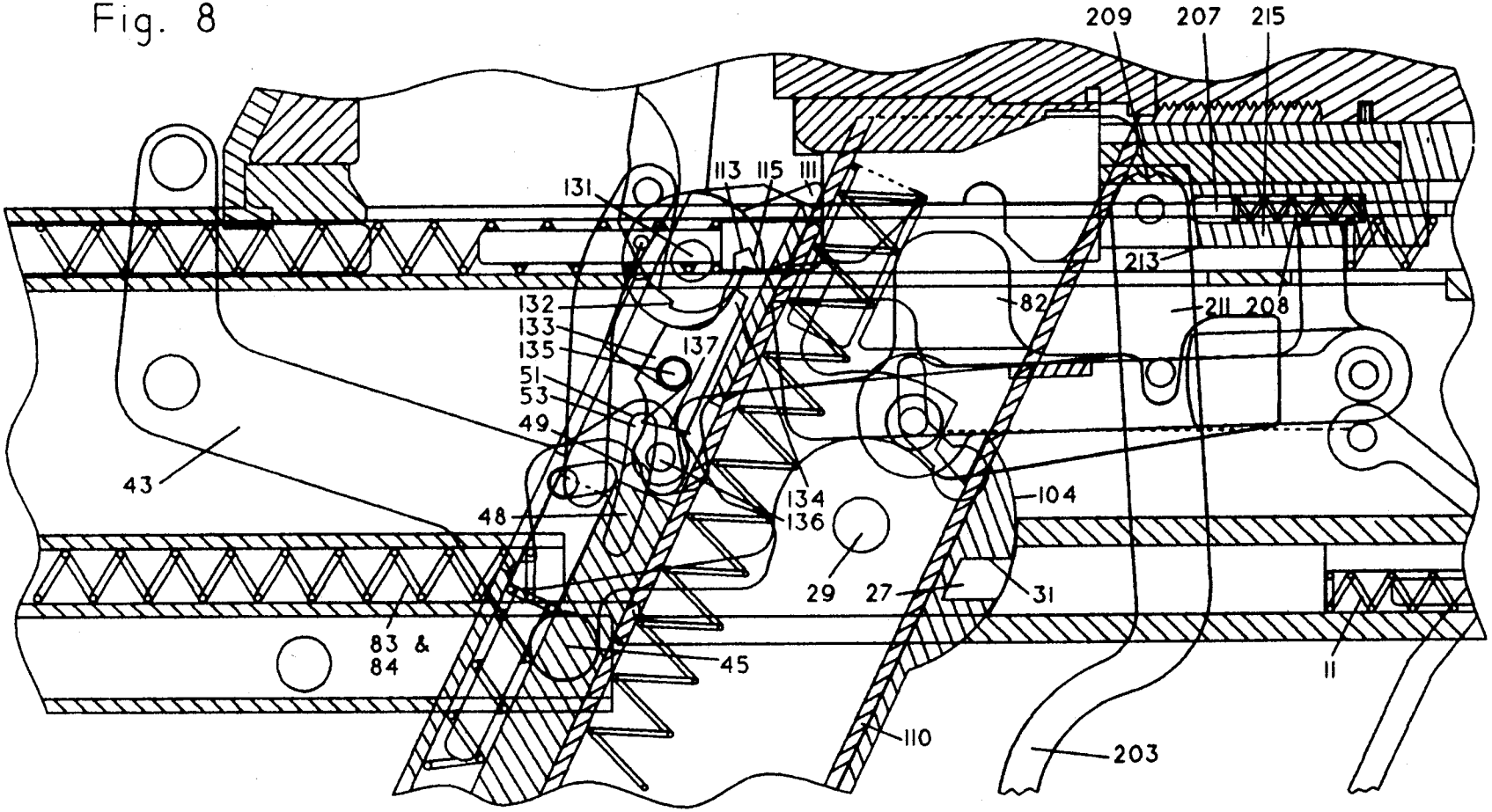
FIG. 8 is an enlarged view of FIG. 7 centered around the grip pivot.
Figure 9A:
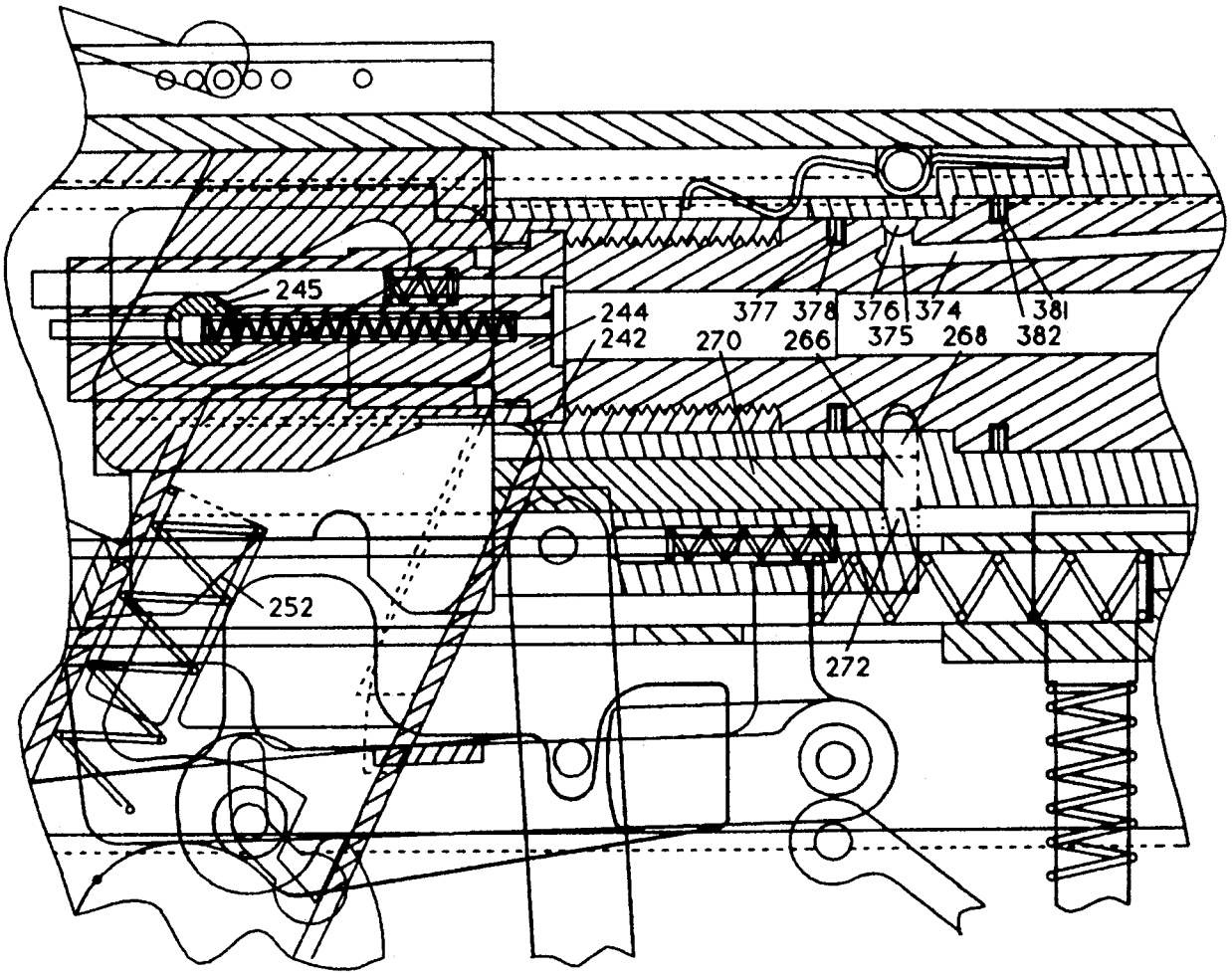
FIG. 9*a* is an enlarged view of FIG. 7 centered around the trigger pivot.

There are several safeties within the scope of the present invention. Referring to FIGS. 7 and 8), assembly safety 55, attached to safety 43, has been previously discussed. Also attached to safety 43 is safety dog 48. Safety dog 48 operates by blocking sear pin 136 from being urged rearward by disconnect link 82 when said disconnect link 82 is biased rearward. Safety dog 48 is engaged or disengaged by upward or downward radial movement around safety pivot 47.

Magazine safety 111 is activated by the removal of magazine 110 from grip 101. When magazine 110 is removed from grip 101 magazine safety 111 rotates clockwise at the urging of sear spring 137, until magazine safety notch 113 is seated on sear tip 134. Surface 115 of magazine safety 111 now effectively prevents forward movement of sear tip 134. Magazine safety 111 is disengaged when magazine 110 is fully inserted into grip 101.

Storage safety 406 is a protrusion extending forward from the center of barrel storage socket 401. During storage it occupies firing chamber 365 thereby effectively forcing a clearing of firing chamber 365 before barrel storage in the standard storage configuration (see FIG. 2) may occur.

The gas operating system is contained in two groups, Group 1 and Group 3, and consists of elements for transfer of gas from barrel 301 to gas cylinder/s 266, elements for sealing said gas transfer from Group 3 to Group 1, and gas piston/s 270.

Gas for operating firearm within the scope of the present invention is routed in successive order through the following: firing chamber 365, bore 366, gas port 367, gas block 330, gas tube 370, gas tube channel 374, manifold port 375, manifold 376, gas cylinder port 268, and gas cylinder 266. Gas is substantially contained in gas manifold 376 by rear gas seal 378 residing in rear seal groove 377, and forward gas seal 382 residing in forward seal groove 381. Gas is distributed to gas cylinders/s 266 by gas manifold 376 through gas cylinder port/s 268. Depending upon recoil energy requirements for operating bolt and/or bolt carrier system/s at operating pressures relevant to cartridge being used in and individual firearm within the scope of the present invention, one or more gas cylinder/s 266 may be active. Gas is delivered to said active cylinder/s 266 through said gas cylinder port/s 268.

Said gas cylinder/s 266 may be rendered inactive by blocking cylinder port/s 268 with cylinder port plug/s 269. When said gas cylinder/s 266 are active bleed port/s 272 are plugged with bleed port plug/s 273. Said gas entering said active cylinder/s 266 then urges piston/s 270 in said active cylinder/s 266 rearward operating bolt and/or bolt carrier system/s in a conventional manner.

Recoil block 215 (see FIGS. 7 and 10) is retained in upper receiver 201 by recoil block pin 214. When recoil block 215, a separable element of upper receiver 201, is locked to upper receiver 201 by recoil block pin 214, upper receiver 201 and recoil block 215 function as an integral unit.

All controls of a firearm within the scope of the present invention are capable of being operated ambidextrously. Said controls are substantially ergonomically balanced and substantially symmetrical about a longitudinal central vertical plane. Additionally, said firearm within the scope of the present invention can be set up to eject in a direction laterally left of said longitudinal central vertical plane or in a direction laterally right of said longitudinal central vertical plane without the substitution and/or addition of any components or parts dedicated to left hand operation and/or ejection, or the substitution and/or addition of any components or parts dedicated to right hand operation and/or ejection.

Figure 9B:
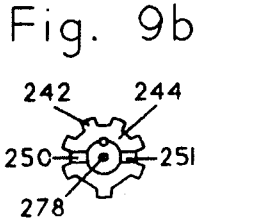
FIG. 9*b* is a front view of the bolt face showing the operating positions of the extractor system.
Figure 9C:
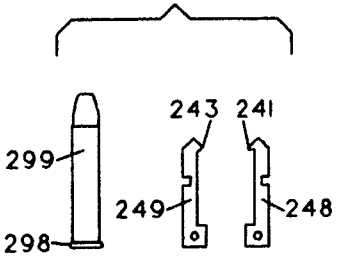
FIG. 9*c* are top views of the primary and the secondary extractors, and a side view of a cartridge.
Figure 9D:
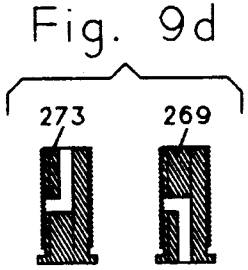
FIG. 9*d* are sectional views of the cylinder port and bleed port plugs and/or orifices.

Referring to FIGS. 9*b* and 9*c*, said setup of direction of ejection laterally to either the left or to the right of said longitudinal central vertical plane of said firearm within the scope of the present invention is accomplished by exchanging the operating positions of primary extractor 248 and secondary extractor 249. If primary extractor 248 is in the right operating position, point 241 of primary extractor 248 will grip cartridge base 298 of cartridge 299 more lockingly than will point 243 of secondary extractor 249 causing cartridge 299 to eject laterally to the right of said longitudinal central vertical plane when ejector 278 centrally urges cartridge 299 forward. If primary extractor 248 is in the left operating position, point 241 of primary extractor 248 will grip cartridge base 298 of cartridge 299 more lockingly than will point 243 of secondary extractor 249 causing cartridge 299 to eject laterally to the left of said longitudinal central vertical plane when ejector 278 centrally urges cartridge 299 forward.

Referring to FIGS. 7, 8, and 9, forward member 81 of bolt assist 80 operates in upper spring guide on opposite side of longitudinal central vertical plane from that of main spring 79. Bolt assist 80 is rearward biased, rotation prevented, and locked by main spring 79. In operation forward member 81 of bolt assist 80 is brought to bear on bolt carrier lower rear protrusion 252 on side of longitudinal central vertical plane opposite main spring follower 78.

Referring to FIG. 7, pin retention member/s 88, hereinafter referred to as pin retaining plate/s 88, can be slideably attached to lower receiver 2 and is/are retained by master pin 17. Said pin retaining plate/s retain a multiplicity of elements and/or pins. Said retained element/s and/or pin/s are retaining and/or providing pivot point/s for fire control and/or other element/s of said firearm within the scope of the present invention. Said pin retaining plate/s 88 provide a ready means for disassembly, field stripping, and/or disassembly of Group 2 element/s of said firearm within the scope of the present invention.

The hereinabove described collapsible firearm is a particular arrangement of a collapsible firearm, described for the purpose of illustrating one embodiment of the advantage to which the present invention may be used, and is not by way of limitation. It should be appreciated that any number of modifications, variations, or equivalent arrangements, both within the field of firearms in specific or with other type weapons in general, may occur to those skilled in the art, and should be considered to be within the spirit and the scope of the invention as defined in the appended claims.

What is claimed is:

1. A collapsible gun comprising:

receiver means including at least first and second receivers;

grip means pivotally disposed within first receiver means for ambidextrous support of the collapsible gun when the collapsible gun is in operative configuration, being further disposed for being pivotally retractile for storage substantially within said first receiver;

lock means to mount second receiver means to first receiver means when the collapsible gun is in operative configuration being removable from said first receiver means for storage substantially within said first receiver means;

said first receiver means configured whereby said second receiver means can be stored substantially within said first receiver means; and, barrel means lockably mounted to one of said first and second receiver means when the collapsible gun is in operative configuration and being removable for storage alongside one of said first and second receiver means.

2. The collapsible gun of claim 1 wherein said grip means includes magazine housing means for supporting a magazine with at least one of said first and second receiver means for feeding ammunition into at least one of said first and second receiver means when the collapsible gun is in operative configuration and for supporting the magazine in a position generally parallel to and substantially within said first receiver means for storage.

3. The collapsible gun of claim 1 including a storage bay configured in operative relationship whereby optical type sighting devices can remain mounted to second receiver means during storage of second receiver means substantially within first receiver means.

4. The invention of claim 1 including a safety means comprising a chamber plug disposed in a storage gate to preclude storage of detachable barrel means when said chamber contains a cartridge.

5. The invention of claim 1 including a mechanism for selecting the direction of cartridge ejection comprising:

a bolt;

an extractor;

a cartridge support;

polymer circumferential biasing means;

said bolt being provided with two operating positions located in radial positions substantially 180 degrees apart with reference to the bolt face of said bolt, said extractor to operate in one of said operating positions and said cartridge support to operate in the opposite said operating position, said extractor and cartridge support being inwardly biased by polymer circumferential biasing means; and, the direction of ejection is selected by interchanging positions of operation of said extractor and said cartridge support, the direction of ejection being lateral of the central vertical plane of the bolt towards the extractor.

6. The invention of claim 1 including a removeable receiver block wherein said receiver means including an outer housing for receiving a the receiver block;

said removeable receiver block is dimensioned to fit said receiver means and further operative whereby said removeable receiver block is dimensioned to accept in operative relationship at least one barrels.

7. The device of claim 6 wherein the removeable receiver block includes means for operative gas transfer from a barrel assembly.

8. The device of claim 6 wherein the removeable receiver block contains at least one gas cylinder and cylinder mount.

9. Firearm receiver means containing a bolt means and a firing mechanism means for a firearm including collapsible grip means pivotably disposed to be received within said receiver means for ambidextrous support of a firearm when the firearm is in an operative configuration where said grip means is pivotably retractable for storage substantially within said receiver means.

10. The device of claim 9 wherein said collapsible grip means includes fire control elements, said fire control elements being disposed within said collapsible grip means in operative relationship being further disposed to engage other fire control elements in operative relationship when said collapsible grip means is pivoted to operative configuration.

11. The device of claim 9 wherein said collapsible grip means includes magazine housing means for supporting a magazine within said receiver means for feeding ammunition into said receiver means when said collapsible grip means is in operative configuration and for supporting a magazine substantially within said receiver means for storage.

12. The device of claim 9 wherein said collapsible grip means includes grip lock means, said grip lock means being operative for locking said collapsible grip means in operative configuration and for locking said collapsible grip means in storage configuration.

13. A collapsible gun comprising barrel means with front right housing means; and a receiver means including barrel storage lock means having socket means adapted to receive said barrel means; whereby one end of said barrel means is received in said storage socket means and said barrel means can be interlocked with said barrel storage lock means to form a storage configuration.

14. The collapsible gun of claim 13 wherein said receiver means further includes storage bay means;

gate means operative in either an open or a closed configuration to retain the contents of said storage bay means in said closed position and being pivotally retracted to access said storage bay means.

15. The collapsible gun of claim 14 wherein said gate means includes a storage socket means disposed in operative relationship whereby the barrel means locks said gate means in closed configuration when said front sight housing means interlocks with barrel storage lock means.

* * * * *